United States Patent [19]

Reimpell et al.

[11] Patent Number: 4,509,807

[45] Date of Patent: Apr. 9, 1985

[54] SLIDING CONTACT ARRANGEMENT FOR TRANSMITTING HEAVY CURRENTS FROM AND TO BUS BARS WITH SLIDE SURFACES

[75] Inventors: Uwe Reimpell, Hanau am Main; Otto Stenzel, Gründau, both of Fed. Rep. of Germany

[73] Assignee: Leybold Heraeus GmbH, Cologne, Fed. Rep. of Germany

[21] Appl. No.: 412,462

[22] Filed: Aug. 27, 1982

[30] Foreign Application Priority Data

Aug. 28, 1981 [DE] Fed. Rep. of Germany ..... 3134017

[51] Int. Cl.[3] ..... H01R 41/00

[52] U.S. Cl. ..... 339/9 R; 373/69; 373/101

[58] Field of Search ..... 339/9 R, 9 E, 112 R, 339/112 L; 373/100, 101, 94, 69, 52

[56] References Cited

U.S. PATENT DOCUMENTS 2,899,667 6/1957 Bredtschneider et al. ..... 339/9 E

FOREIGN PATENT DOCUMENTS 2731198 6/1978 Fed. Rep. of Germany ..... 373/52

*Primary Examiner*—Eugene F. Desmond

*Attorney, Agent, or Firm*—Felfe & Lynch

[57] ABSTRACT

A sliding contact arrangement for transmitting heavy currents to and from a bus bar has a cage with conductive contact faces and an arrangement to cause a conductive sliding contact to bear on the bus bar and only one of the contact faces.

14 Claims, 3 Drawing Figures

Figure 1:
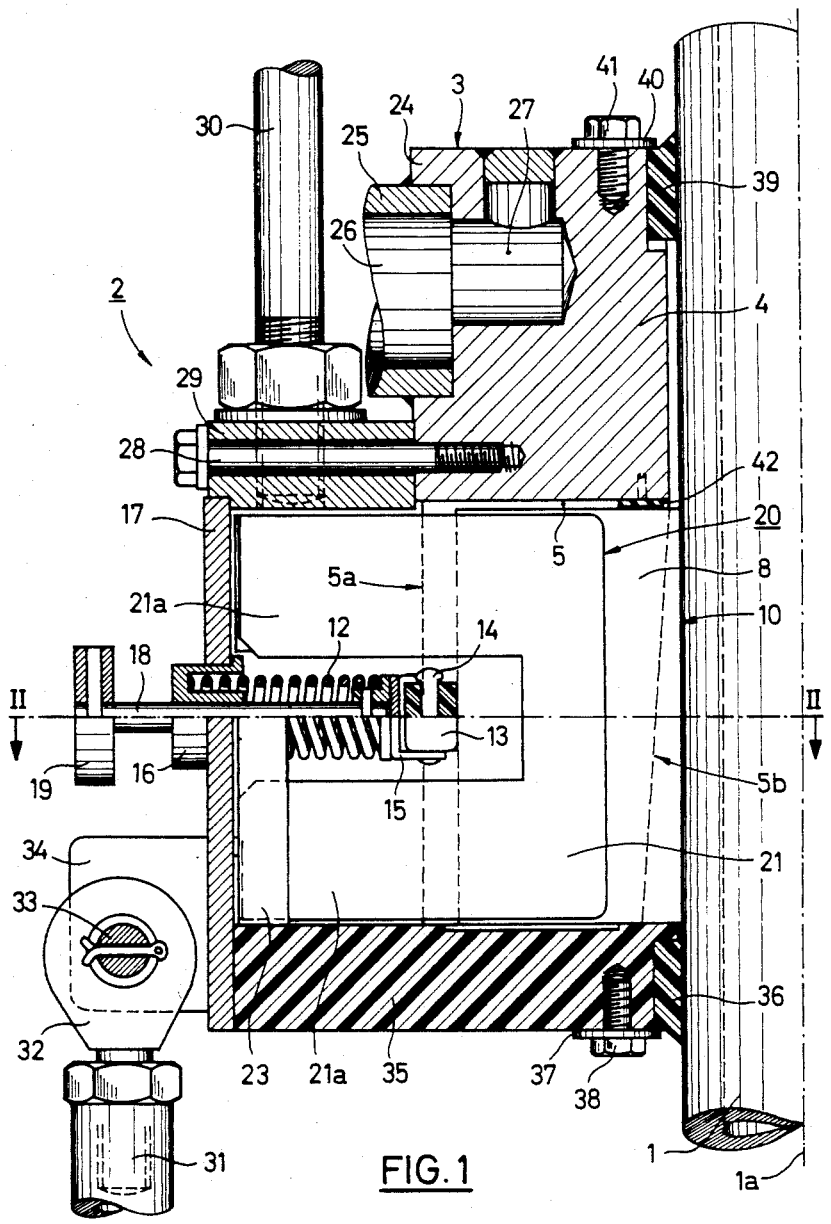

SLIDING CONTACT ARRANGEMENT FOR TRANSMITTING HEAVY CURRENTS FROM AND TO BUS BARS WITH SLIDE SURFACES

The invention concerns a sliding contact arrangement for the transmission of heavy currents from and to bus bars.

Sliding contact arrangements of this kind can be used, for example, in electrical-metallurgical furnaces in which fusible electrodes are remelted with low voltages and heavy currents. Such electrodes are progressed during their remelting to require sliding contact transmission of current between relatively-movable parts if flexible current supply lines are not used.

Sliding contact arrangements of this kind are also used in electrical-slag-melting installations supplied with current at mains frequency. These contact arrangements are used, on the one hand, between a positionally fixed current supply and a movably-driven electrode holder and, on the other hand, when what are called sliding moulds with downwardly movable bottom plates are used, between the bottom plate and fixed bus bars. The sliding contact arrangements concerned have to transmit current of 45,000 Amperes and more. The bus bars used normally take the form of tubes of circular cross-section on which the sliding contacts are moved. The movement is relatively slow but efficient, uninterrupted contact must be ensured so that no interruptions in the supply of current or changes in current strength occur during the melting operation.

Sliding contacts are known wherein spherical contact faces made of slidable heat-resisting material are pressed by springs against bus bar. These use what are called multi-contacts which permit a forward movement and therefore matching of the sliding contacts. The multi-contacts are arranged in copper guide elements to which cables or other connecting lines are attached.

It is also known to use, instead of the sliding contacts with spherical contact faces, carbon brushes and to connect these by cables or conductor strands to an element for guiding the carbon brushes. It has been found, however, that because of inadequate cooling of the carbon brushes, the strands and the elements guiding the carbon brushes, overheating occurs as a result of the heavy currents and causes rapid wear of the brushes and reduced life of the other components involved.

The object of the present invention is, therefore, to provide a sliding contact arrangement whereby heavy currents can be reliably transmitted over a lengthy period without local overheating along the current paths and, therefore, without premature wear of the components carrying the heavy currents.

According to the invention, this object is achieved in a sliding contact arrangement in that at least one contact face is conductive and directed toward the bus bar, and in a way of causing a sliding contact to bear conductively against the bus bar and the one contact face.

The expression "complementary" is here taken as meaning that the inner shape of a cage corresponds substantially to that of the surface of the bus bar, without the cage bearing directly on the bus bar.

As a result of the stated arrangement, the slide faces between preferably-plural sliding contacts and the bus bar are substantially at right angles to the contact faces between the sliding contacts and a cage if the fact that the slide faces are portions of cylindrical faces is ignored. Because the stated contact faces are directed substantially towards the bus bar, these faces can be designed to be very large, and efficient transmission of current is achieved in view of the flatness of the contact face. This leads to low surface loading and therefore also to extremely reduced heating in the zone of the current path. The contact faces permit displacement of the sliding contact relative to the cage, without the occurrence of any adverse effect upon transmission of current. These relative movements are, however, extremely small; they merely correspond to an extremely slight possible displacement of the cage relative to the bus bars and wear on the faces of the sliding contacts that occurs in the course of time.

On the other hand, the slide faces or end faces of the sliding contacts are smaller, so that greater surface loading by the current occurs. However, as will be explained later herein, the sliding contacts can be efficiently cooled by dissipation of heat laterally by way of contact faces of the cage. It is also possible to effect efficient cooling of the bus bars which are usually hollow, and further dissipation of heat in the axial direction is promoted as the result of the heat-conducting properties of the material of the bus bar (copper).

In the arrangement in accordance with the invention, it is possible to dispense completely with cables, conductor strands or other resistance-affected transmission means between the sliding contacts and the cage. The arrangement of the invention is distinguished by its great reliability, long service life and simple construction, accompanied by favourable manufacturing costs. Despite the heavy currents that are transmitted and are in the order of magnitude of 45,000 Amperes and more, no appreciable change in contact resistance occurs, and in particular, no interruption or change whatever in the supply of current for melting. The last-mentioned advantage is of particular importance in remelting furnaces, since any interruption in current leads to interruption of the melting operation which cannot thereafter be resumed. A marked drop in current manifests itself in clearly visible differences in the crystallization process in the ingot produced in the remelting process. These differences can be seen in the micrograph of an ingot as roughly parabolic striations and are indications of a reduction in the quality of the finished ingot.

In accordance with a further feature of the invention, it is particularly advantageous if the cage consists of an annular basic element which surrounds the bus bar and has a connector portion for the current conductor, a cooling agent supply pipe and a cavity for circulation of the cooling agent, the cage also comprising a plurality of substantially sector-shaped prolongations, which are distributed along the periphery of the basic element, extend in the axial direction from the basic element, are in good heat-conducting and current-conduction contact with the basic element and, between them, accommodate the sliding contacts and, if the substantially radial lateral faces of the prolongations are the contact faces of the cage, on which faces bear the faces of the sliding contacts that are parallel to the main plane.

The prolongations and basic elements are preferably produced as a single part made of copper, the prolongations being roughly in the shape of wedges. This results in very good transfer of heat from the prolongations to the basic element and from the latter to the cooling agent (water). Since the sliding contacts are preferably made of graphite, heat and current are efficiently transmitted to the prolongations. Consequently, the sliding contact arrangement of the invention can be cooled in an extremely efficient manner, and it is even possible to extend the cavities for the cooling agent into the prolongations. Because of the effective cooling it is possible to displace the sliding contacts on the contact faces towards the bus bars over a considerable distance so as to offset the usual rubbing without thereby adversely affecting the heat and current transfer conditions to any appreciable extent.

According to a further feature of the invention, an added special advantage is achieved if two sliding contacts are arranged in each gap formed between each two sector-shaped prolongations, a splaying spring system being located between each two sliding contacts, by means of which system the sliding contacts are urged in opposite directions against the associated face of the cage. By means of such arrangement, a very compact construction, in which all the contact faces are concentrated in a relatively small zone, is achieved, and the form of the cage, in which the gaps are located, is greatly simplified. In this arrangement, each one sliding contact forms the backing for the other as regards the splaying spring system, so that not only is a construction that is symmetrical in relation to a gap achieved, but also a symmetrical distribution of the spring forces. Considerable pressure-applying forces can be produced in this way, so that particularly favourable conditions are achieved as regards the transmission of heat and current.

The required radial pressure of the sliding contacts against the bus bars is achieved by means of compression springs which act in the radially inward direction. In a further feature of the invention and in view of the arrangement of the sliding contacts in pairs, special advantages are achieved when each compression spring centrally engages a double-armed lever, the two arms of which bear against those faces of the sliding contacts that are turned away from the slide faces. In this way, specific forces which press the sliding contacts concerned against the bus bars are achieved in a particularly compact construction.

A particularly space-saving arrangement is obtained when the splaying spring system consists of leaf springs which are arranged in pairs and are roughly U-shaped, and when the compression springs are arranged between the limbs of the leaf springs.

A still further advantage accrues if the inner edges of the sector-shaped prolongations are a substantial distance from the bus bar. Since the sliding contacts must of necessity touch the bus bar, the above-mentioned arrangement results in a part of the sliding contacts, which does not project towards the bus bar, not being in contact with the prolongations of the cage. This provision leads to equalization of the current density in the slide face and therefore to more uniform loading.

Figure 2:
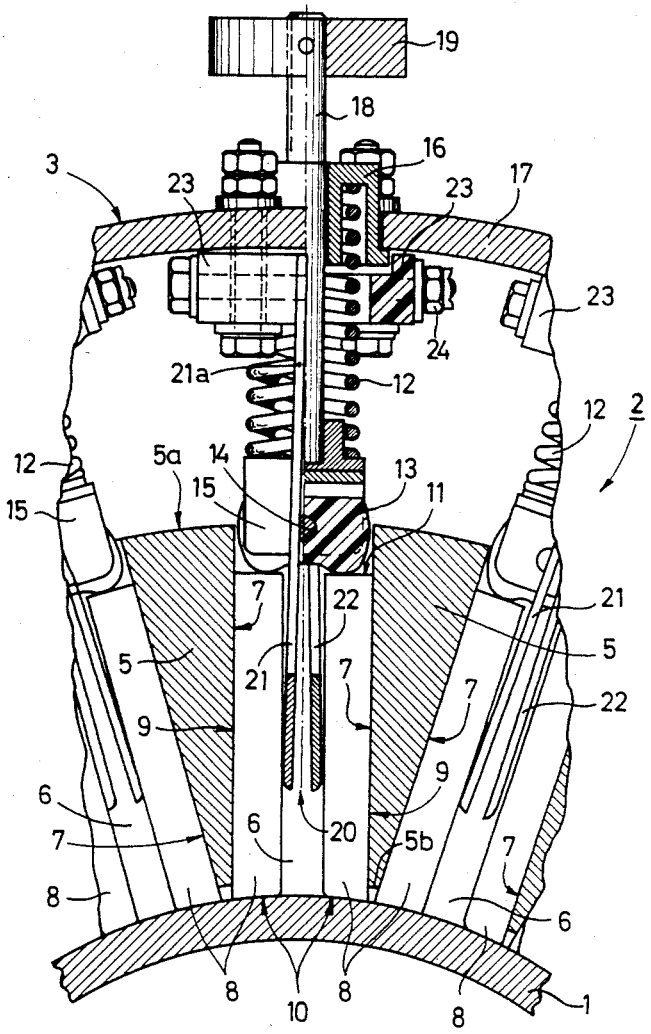
Figure 3:
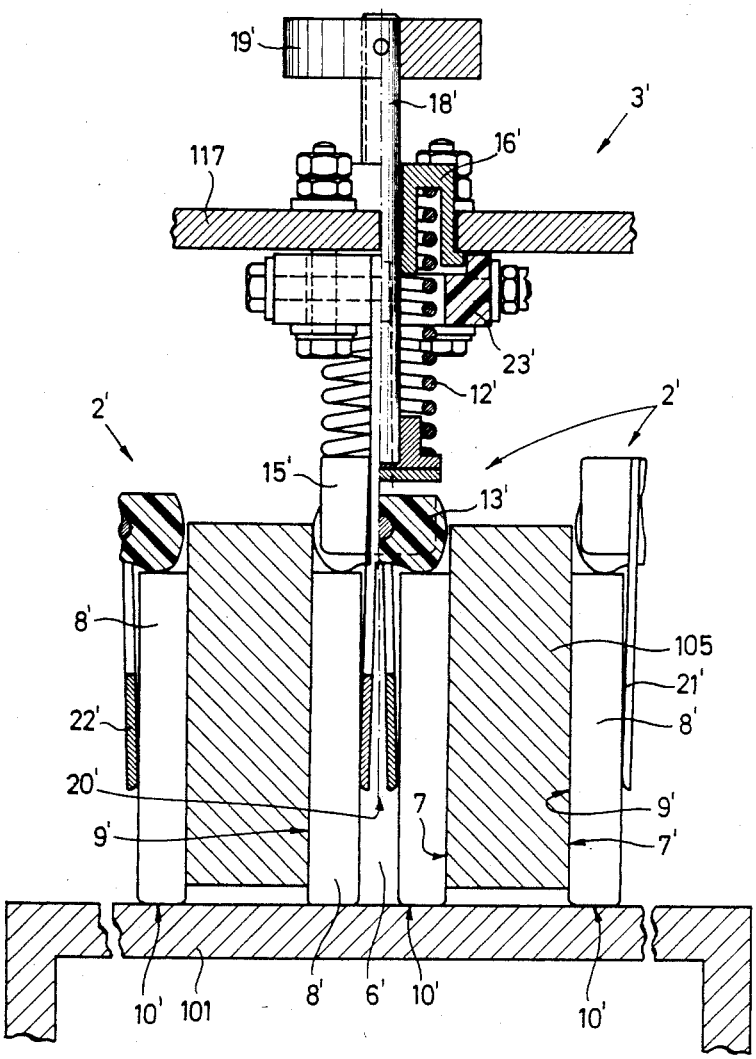

Further advantageous forms of the invention will now be described in greater detail by reference to FIGS. 1 to 3 in which:

FIG. 1 illustrates half an elevation, partly in section, of one preferred embodiment with a cylindrical contact face, FIG. 2 shows, on a larger scale, a section through FIG. 1 along the line II—II, and FIG. 3 is a section, similar to that of FIG. 2, of another preferred embodiment with a planar contact face.

FIGS. 1 and 2 show a portion of a hollow cylindrical bus bar 1 which is made of copper and is concentrically surrounded by the sliding contact arrangement 2 of the invention. This arrangment comprises a cage 3, which consists of an annular basic element 4, surrounding the bus bar 1, and of a plurality of sector-shaped prolongations 5, which are distributed on the periphery of the basic element and the radially outwardly facing ends of which are disposed at a cylindrical face 5*a*. The radially inwardly directed ends 5*b* of the prolongations are at an appreciable distance from the outer face of the bus bar 1. The prolongations 5 are substantially in the shape of wedges and are formed integrally with the basic elements 4 and are made of copper. The ends 5*b* are at a sharp (acute) angle to the surface of the bus bar converging (diminishing spacing) in the direction of flow of current in the bus bar. Thus, different lengths of paths for the flow of current and therefore different resistances are created in the current-conducting portions and this results in uniform current density in the cross-sections concerned.

Between the prolongations 5 of the cage 3 are a similar number of gaps 6 defined by contact faces 7 of the prolongations 5 which, across each gap 6, extend in plane-parallel relationship to each other. The plane-parallel nature of the contact faces 7 of each gap 6 results in these contact faces being directed only substantially radially towards the bus bar. In reality, the planes, in which the contact faces 7 lie, do not intersect the longitudinal axis 1*a* of the bus bar, but extend at a distance therefrom that corresponds to half the width of each gap 6. This relatively slight deviation is, however, completely unimportant as regards the functionability of the subject-matter of the invention. In any case, the plane of symmetry of gap 6 runs through the longitudinal axis 1*a* of the bus bar 1.

Arranged in each gap 6 are two block-shaped sliding contacts 8 made of graphite, and a face 9 of each contact that is parallel to its main plane is in surface contact with one of the contact faces 7 of the cage. The end faces of the sliding contacts 8 are on the bus bar 1 to form current-transmitting slide faces 10. A compression spring 12 acts from the cage 3 in the radial direction on each end face 11 of the contacts 8 remote from the slide faces 10. This is achieved by a double-armed lever 13, which is swivellably mounted on a shaft 14. The shaft 14 is in turn mounted in a U-shaped bracket 15 which also embraces the lever 13 at opposite sides. The compression springs 12 bears against the bracket 15 so that the lever 13 presses the sliding contacts 8 against the bus bar 1 with uniformly distributed force.

The opposite end of the compression spring 12 is mounted in a sleeve 16 which is inserted in a hole drilled in the wall 7 of the cage. A tie-rod 18 leads from the bracket 15 to an actuating button 19 whereby the lever 13 can be withdrawn radially outwards for the purpose of fitting new sliding contacts 8. The tie-rod 18, in conjunction with the bracket 15, at the same time forms a guide for the compression spring 12.

Between the sliding contacts 8 in each gap 6 is a splaying spring system 20 pressing the sliding contacts 8 in opposite directions against the associated contact faces 7 of the cage 3. The splaying spring system 20 consists of U-shaped leaf springs 21 and 22 which are arranged in pairs and are outwardly biased in relation to an intermediate plane of symmetry. The leaf springs each comprise limbs 21*a* which embrace the associated compression spring 12 on roughly diametrically opposite sides. The ends of the limbs 21*a* are held between insulating elements 23 by clamping screws 24. The double-armed lever 13 is also made of an insulating material so that no current paths whatsoever can be set up in any portions of the spring system.

FIG. 1 also shows the following:

The basic element 4 has a connector portion 24 for a current conductor 25, which also incorporates the cooling agent supply pipe 26. This pipe 26 leads to a cavity 27 for circulation of the cooling agents, which cavity is shown only in part and extends at least to the periphery of the basic element 4.

Secured to the basic element 4 by means of radial screws 28 is a ring 29 made of high-quality steel in which is fitted a tie-rod 30 whereby the contact arrangement is suspended from a part, not illustrated, of a furnace frame. Adjustment of the contact arrangement is carried out by means of a three-link system, of which is shown only one link bar 31 which is connected to the wall 27 of the cage by way of a ring 32, a bolt 33 and a side strap 34. The wall 27 of the cage is welded to the periphery of the ring 29. Inserted into the wall 17 of the cage, from below, is an annular insulating plate 35 which has, in a concentric machined recess, a slide ring 36 which is retained therein by a metal ring 37 and screws 38. The basic element 4 has a further concentric machined recess in which a further slide ring 39 is held by a metal ring 40 and several screws 41. The two slide rings 36 and 39 are made of a slidable plastic or insulating material and they are provided with outwardly extending stripping edges. The contact arrangement bears, in the radial direction, against the bus bar 1 by way of these slide rings and at the same time it is centered in a reliable manner.

The lower ends of the sliding contacts are supported on the insulating plate 35, whereas a ring 42 (FIG. 1) of insulating material is arranged between the upper ends of the sliding contacts 8 and the basic element 4. This arrangement also avoids unrequired induction-current paths.

When the sliding contact arrangement is operating, current flows form the bus bar 1 by way of the slide faces 10 into the contact plates 8 and from here, by way of the contact faces 7, into the sector-shaped prolongations of the basic element 4. Current flows from the basic element 4 to the conductor 25. During displacement, the sliding contact arrangement 2 is guided by the slide rings 36 and 39 on the bus bar 1, so that a well-defined axial and radial movement of the slide faces 10 relative to the cage is set up without the occurrence of any change in the geometric relationship at the contact faces.

The expression "main plane" of the sliding contacts will be understood as meaning that plane that passes through the center of the mass of the sliding contacts and parallel to the largest cross-sectional surface in which the longest cross-sectional diagonals also lie.

FIG. 3 illustrates a variant of the sliding contact arrangement of FIGS. 1 and 2; in FIG. 3 parts having the same functions and substantially the same geometry as the equivalent parts shown in FIGS. 1 and 2 have been allotted the same, but primed reference symbols as in the latter Figures If individual parts are of a substantially different shape from those of FIGS. 1 and 2, the reference symbols include an initial numeral "1" for clearer differentiation.

It will be seen that the bus bar 101 has a flat contact surface on which bear the slide faces 10' of the substantially unchanged slide contacts 8'. The only difference is that the slide faces 10' are not concave but are of flat shape to complement the contact surface.

The prolongations 105 on the cage 3' are not sector-shaped however, but are of block form, i.e. the contact surfaces 7' are disposed in plane-parallel relationship to each other. In this way a comb-shaped arrangement of prolongations 105 is created, and this can be imagined to be extended to the left and to the right in the FIG. 3 illustration. The prolongations 105 enclose the gaps 6' which—as previously—are delimited by the plane-parallel contact surfaces 7'. The system of compression springs 12 and splaying springs 20', serving to apply pressure to the current-carrying parts, is likewise practically unchanged, though the spring systems are not radially directed, but are secured, by means of the previously described fixing element, to a cage wall 117 which is of planar form and extends parallel to the row of prolongations 105.

We claim:

1. In a sliding contact arrangement for transmitting a heavy current to or from a bus bar having a slide surface along which the arrangement is to be slidably movable, the arrangement having cage means (3) for mounting the arrangement on the bus bar slidably of the slide surface of the bus bar, the cage means (3) having prolongation means (5), the prolongation means (5) comprising at least one current-conducting contact face (7) extending toward the slide surface of the bus bar to an inner end (5*b*) thereby when the arrangement is mounted thereon and defining a space (6) from an adjacent portion of the cage means for receiving at least one current-conducting sliding contact (8) in the space (6), the sliding contact (8) having a slide face (10) for engaging the slide surface of the bus bar, whereby to transmit the heavy current thereto or therefrom, and a face (9) for engaging the contact face (7), the improvement comprising:

means in the cage means (3) for transmitting the heavy current to or from the prolongation means (5);

the current-conducting contact face (7) of the prolongation means (5) conducting the heavy current to or from the sliding contact (8) when engaged therewith; whereby to distribute the density of the heavy current over the engaged faces; and engaging means (21, 13) for engaging the face (9) of the sliding contact (8) with the contact face (7) of the prolongation means (5) and for engaging the face (10) of the sliding contact (8) and the slide surface of the bus bar (1) sufficiently for conducting the heavy current therebetween with the sliding contact (8) spaced from the adjacent portion of the cage means across the space (6) when the sliding contact is received in the arrangement and the arrangement is mounted the bus bar.

2. The sliding contact arrangement according to claim 1, for a bus bar having a cylindrical slide surface, wherein:

the cage means (3) comprises an annular basic element (4) which surrounds the bus bar when the arrangement is mounted thereon, a connector portion (24) for a current conductor (15), a cooling agent supply pipe (26) and a cavity (27) for circulation of the cooling agent; and the prolongation means (5) comprises substantially sector-shaped prolongations (5) which are distributed around the periphery of the basic element (4), are in good heat-conducting and current-conducting contact with the basic element and, between them, define plural spaces (6), each to accommodate at least one sliding contact.

3. The sliding contact arrangement according to claim 2, wherein the inner end (5*b*) of the prolongation means (5) is a substantial distance from the bus bar when the cage is mounted thereon.

4. The sliding contact arrangement according to claim 3, wherein the spacing of the inner end (5*b*) of the prolongation means (5) diminishes in the direction of the current in the bus bar when the cage is mounted thereon and the current flows therein.

5. The sliding contact arrangement according to claim 2 wherein the portion of the cage means adjacent each contact face (7) is another contact face (7) and two sliding contacts are arranged in each space (6), and wherein the engagement means comprises a splaying spring system (20) in each space for urging the two sliding contacts in opposite directions against the associated contact faces (7).

6. The sliding contact arrangement according to claim 5, wherein the engagement means further comprises compression spring means (12, 13) which acts radially inwards in the cage (3) for urging each of the sliding contacts against the bus bar when the cage is mounted thereon.

7. The sliding contact arrangement according to claim 6, and further comprising a cage wall (17) concentrically surrounding the sliding contacts and the sector-shaped prolongations (5) and mounting the compression springs (12) for engaging the sliding contacts.

8. The sliding contact arrangement according to claim 6, wherein the compression spring means comprises, for each sliding contact, a compression spring (12) and a double-armed lever (13) centrally engaged by the spring, the two arms of the lever (13) being for spacedly bearing against faces of the sliding contacts that are opposite the slide faces.

9. The sliding contact arrangement according to claim 6, wherein the splaying spring system (20) comprises leaf springs (21, 22) arranged in pairs.

10. The sliding contact arrangement according to claim 9, wherein the leaf springs (21, 22) are connected by a substantially U-shaped end portion (21*a*), and the compression springs (12) are arranged between the limbs of the U-shaped end portion (21*a*) of the leaf springs.

11. The sliding contact arrangement according to claim 1, and further comprising spaced slide rings (36, 39) on the cage means (3) for supporting an insulating it in the radial direction when on the bus bar.

12. The sliding contact arrangement according to claim 1, and further comprising insulating elements (35, 42) in the cage means (3) for holding the sliding contact in the axial direction between the insulating elements (35, 42).

13. The sliding contact arrangement according to claim 1, wherein the inner end (5*b*) of the prolongation means (5) is a substantial distance from the bus bar when the cage is mounted thereon.

14. The sliding contact arrangement according to claim 13, wherein the spacing of the inner end (5*b*) of the prolongation means (5) diminishes in the direction of the current in the bus bar when the cage is mounted thereon and the current flows therein.

* * * * *